US007121934B2

(12) United States Patent
Jung

(10) Patent No.: US 7,121,934 B2
(45) Date of Patent: Oct. 17, 2006

(54) CARRIER HEAD FOR CHEMICAL MECHANICAL POLISHING APPARATUS

(75) Inventor: Taek-Soo Jung, Anyang (KR)

(73) Assignee: Doosan DND Co., Ltd., Ansan (KR)

( * ) Notice: Subject to any disclaimer, the term of this patent is extended or adjusted under 35 U.S.C. 154(b) by 0 days.

(21) Appl. No.: 11/133,148

(22) Filed: May 18, 2005

(65) Prior Publication Data

US 2005/0272355 A1 Dec. 8, 2005

Related U.S. Application Data

(63) Continuation of application No. PCT/KR02/02176, filed on Nov. 21, 2002.

(51) Int. Cl.
*B24B 29/00* (2006.01)

(52) U.S. Cl. ..... 451/285; 451/288; 451/289; 451/398; 451/494

(58) Field of Classification Search ..... 451/41, 451/285, 287, 288, 289, 397, 398, 494
See application file for complete search history.

(56) References Cited

U.S. PATENT DOCUMENTS

| | | | | |
|---|---|---|---|---|
| 5,643,061 | A * | 7/1997 | Jackson et al. | 451/289 |
| 5,681,215 | A | 10/1997 | Sherwood et al. | |
| 5,762,544 | A | 6/1998 | Zuniga et al. | |
| 5,957,751 | A | 9/1999 | Govzman et al. | |
| 6,162,116 | A | 12/2000 | Zuniga et al. | |
| 6,224,472 | B1 * | 5/2001 | Lai et al. | 451/398 |
| 6,435,949 | B1 * | 8/2002 | Katsuoka et al. | 451/59 |
| 6,540,590 | B1 * | 4/2003 | Kajiwara et al. | 451/41 |
| 6,558,232 | B1 * | 5/2003 | Kajiwara et al. | 451/41 |
| 6,767,276 | B1 * | 7/2004 | Keller | 451/328 |
| 6,852,019 | B1 * | 2/2005 | Togawa et al. | 451/288 |
| 6,893,327 | B1 * | 5/2005 | Kajiwara et al. | 451/41 |
| 6,966,822 | B1 * | 11/2005 | Kajiwara et al. | 451/41 |

FOREIGN PATENT DOCUMENTS

| | | |
|---|---|---|
| JP | 9168969 | 6/1997 |
| KR | 2000-0071788 | 11/2000 |

* cited by examiner

*Primary Examiner*—Eileen P. Morgan
(74) *Attorney, Agent, or Firm*—Peter S. Gilster; Greensfelder, Hemker & Gale, P.C.

(57) ABSTRACT

Disclosed is a carrier head of a chemical mechanical polishing apparatus for planarizing a semiconductor wafer. An adjustment chamber is provided in a space section formed between a membrane lower holder and a membrane upper holder of a wafer support assembly. Pressure applied to the adjustment chamber is transferred to a rear surface of a membrane during a polishing process through a perforated hole formed at a center of the membrane lower holder. A center portion of the membrane is connected to a vacuum pipe by passing through a hole of the membrane lower holder and the adjustment chamber. Vacuum pressure is directly applied to a wafer so that the wafer is easily attached to the carrier head at lower pressure. Pressure is evenly distributed over the whole area of the wafer so that the wafer is evenly polished.

4 Claims, 6 Drawing Sheets

CARRIER HEAD FOR CHEMICAL MECHANICAL POLISHING APPARATUS

RELATED APPLICATION

This application is a continuation under 35 U.S.C. § 365 (c) of International Application No. PCT/KR2002/002176 filed Nov. 21, 2002, designating the United States. International Application No. PCT/KR2002/002176 has been published in English as WO 2004/075275 A1 on Sep. 2, 2004, which is incorporated herein by reference.

TECHNICAL FIELD

The present invention relates to a chemical mechanical polishing (CMP) apparatus, and more particularly to a carrier head of a chemical mechanical polishing apparatus for planarizing a semiconductor wafer by polishing the semiconductor wafer.

DISCUSSION OF RELATED TECHNOLOGY

Generally, chemical mechanical polishing apparatuses are used for planarizing a surface of a semiconductor wafer in order to reduce ununiformity of the surface of the semiconductor wafer caused by repetition of semiconductor wafer fabricating processes, such as masking, etching, and wiring processes.

Such a chemical mechanical polishing apparatus polishes the semiconductor wafer by utilizing an interaction of two stages of processes. The first stage is a chemical polishing process, in which a semiconductor wafer formed with predetermined layers is placed on a polishing pad and polishing solution, such as slurry, is coated on an upper surface of the polishing pad in such a manner that a chemical reaction is created on a surface of the semiconductor wafer, thereby attenuating chemical bonding strength of the semiconductor wafer. The second stage is a mechanical polishing process, in which the semiconductor wafer is pressed by means of a carrier head, and at the same time, a polishing pad or the carrier head is moved such that friction occurs on the surface of the semiconductor wafer, thereby removing activated films from a surface of the semiconductor wafer.

In order to planarize the semiconductor wafer, a non-polishing surface of the semiconductor wafer is loaded on the carrier head, and a polishing surface of the semiconductor wafer is aligned in opposition to the polishing pad. In this state, slurry is fed between the polishing pad and the polishing surface of the semiconductor wafer so as to polish the semiconductor wafer.

The carrier head has an attachment section, to which the semiconductor wafer is attached before a polishing process is carried out. In addition, the carrier head is used for accommodating the semiconductor wafer therein while the polishing process is being carried out through an interaction between the carrier head and the polishing pad. After the polishing process has been carried out, the semiconductor wafer is unloaded from the carrier head and is conveyed into a position for the next stage.

However, it is difficult to attach the semiconductor wafer to the carrier head before a chemical mechanical polishing process is carried out and to detach the semiconductor wafer from the carrier head or the polishing pad after the chemical and mechanical polishing processes have been finished.

In order to attach the wafer to the carrier head before the chemical mechanical polishing processes, an additional wafer attachment process is required. Generally, the semiconductor wafer is attached to the carrier head by means of vacuum suction or the like.

Examples of such carrier heads are disclosed in the Korean Laid-open publication No. 2000/71788 and Japanese Laid-open publication No. 9-168969. According to the above patent applications, as shown in FIG. 1, a plurality of suction holes 28 are formed in a membrane lower holder 11 of a wafer support assembly 6 and a membrane 12 is attached to an outer upper portion of the membrane lower holder 11. In addition, a flexible rib section 32 is integrally protruded from a lower portion of the membrane 12 adjacent to an edge of the membrane lower holder 11. Accordingly, when a semiconductor wafer is loaded on the membrane 12 by means of vacuum suction supplied through the suction holes 28, the rib section 32 of the membrane 12 completely surrounds an edge of the semiconductor wafer.

That is, in the conventional carrier head 180 having the above structure, the semiconductor wafer is securely mounted on the membrane 12 made from flexible material, and then, vacuum pressure is applied to the membrane 12 through the suction holes 28 so that the membrane 12 is biased towards an adjustment chamber 13. Accordingly, the semiconductor wafer is also biased towards the adjustment chamber 13. In addition, in order to securely load the semiconductor wafer on the membrane 12, the flexible rib section 32 is integrally formed with an edge of the membrane 12.

However, according to the above conventional structure, vacuum pressure of the adjustment chamber 13 applied to the semiconductor wafer is relatively lower than vacuum pressure applied to the membrane 12, so a suction error may occur against the semiconductor wafer loaded on the membrane 12. For this reason, the semiconductor wafer may drop down from the carrier head 180 when the semiconductor wafer is moved or when the wafer is detached from the membrane 12, thereby causing scratches on a wafer pattern or breaking the semiconductor wafer.

In addition, when the semiconductor wafer is attached to the carrier head 180 by detaching the semiconductor wafer from the polishing pad after the polishing process a greater suction force must be applied to the semiconductor wafer because surface tension may create on a surface of the semiconductor wafer due to deionized water or residual slurry adhering to the polishing pad. Thus, in order to form desired vacuum pressure for the conventional carrier head 180, the semiconductor wafer must be closely mounted on the membrane 12 by applying a greater physical force to the flexible rib section 32. For this reason, excessive force may be applied to the semiconductor wafer, causing damage to the semiconductor wafer.

In addition, a wafer detecting function is additionally required for the conventional carrier head 180 in order to check whether or not the semiconductor wafer is attached to the carrier head 180 with a proper pressure. However, an internal structure of the carrier head 180 must be complicated in order to realize the wafer detecting function in the carrier head 180 while creating a relatively high detection error.

Furthermore, although the membrane 12 formed with the rib section 32 may securely attract the semiconductor wafer thereon, the rib section 32 must be protruded from the membrane 12. In addition, in order to utilize the rib section 32, the rib section 32 must sufficiently extend downward from a wafer attachment section of the membrane 12 by controlling pneumatic pressure. Thus, an additional structure for a pneumatic pressure control is required, which may further complicate the structure of the carrier head 180. In this case, an additional internal sensor is required for detecting the semiconductor wafer.

SUMMARY OF CERTAIN INVENTIVE ASPECTS

One aspect of the invention provides a carrier head capable of attaching a semiconductor wafer thereto at a low vacuum pressure by directly applying vacuum pressure to the semiconductor wafer while evenly polishing a surface of the semiconductor wafer by uniformly applying pressure over the whole surface of the semiconductor wafer when a wafer polishing process is carried out.

Another aspect of the invention is to provide a carrier head capable of detecting an attachment status of a semiconductor wafer by directly detecting variation of pneumatic pressure in a vacuum pipe using a pressure adjusting unit without installing a wafer detecting device causing the carrier head to have a complicate structure.

Another aspect of the present invention is to provide a carrier head capable of easily removing impurities, such as slurry residuals, which may penetrate into the carrier head during a wafer polishing process.

The carrier head of a chemical mechanical polishing apparatus comprises a carrier housing driven by a carrier driving shaft; a holder housing installed at a lower center portion of the carrier housing and having a ring shape; a wafer support assembly vertically moving up and down along an inner wall of the holder housing; and a mounting chamber for allowing the wafer support assembly to slidably move up and down along the inner wall of the holder housing formed at a center of the holder housing, wherein the wafer support assembly includes an adjustment chamber, to which pressure is applied, and a membrane formed at a center thereof with a hole, pressurized fluid is introduced into the adjustment chamber while a polishing process is being carried out so that the membrane is outwardly expanded, thereby applying force to a predetermined portion of a rear surface of a wafer, a suction unit is formed at a center of the membrane such that the suction unit is connected to a vacuum pipe by passing through the adjustment chamber, and a retainer ring is installed at an outer portion of the wafer support assembly in such a manner that the retainer ring vertically moves in perpendicular to a lower surface of the wafer support assembly.

According to an embodiment of the present invention, the wafer support assembly includes a holder shaft inserted into a hole formed at a center of the holder housing and vertically moved in the hole, a membrane upper holder mounted at a lower portion of the holder shaft, and a membrane lower holder positioned at a lower portion of the membrane upper holder. Both ends of the membrane are fixed to the upper holder 8 and the membrane lower holder so as to provide a mounting surface for the wafer.

The retainer ring and a conditioner are installed at the outer portion of the wafer support assembly in such a manner that the retainer ring and the conditioner vertically move in perpendicular to the lower surface of the wafer support assembly. The up/down movement of the retainer ring and the conditioner is controllable regardless of the up/down movement of the wafer support assembly.

A vacuum pressure adjusting unit having a function of a pressure meter is connected to the vacuum pipe in order to measure vacuum pressure applied to the wafer, thereby detecting an attachment status of the wafer.

BRIEF DESCRIPTION OF THE DRAWINGS

The foregoing and other objects, features and advantages of the present invention will become more apparent from the following detailed description when taken in conjunction with the accompanying drawings in which.

EMBODIMENTS OF THE INVENTION

Reference will now be made in detail to certain embodiments of the present invention with reference to FIGS. 2 to 5.

Figure 1:
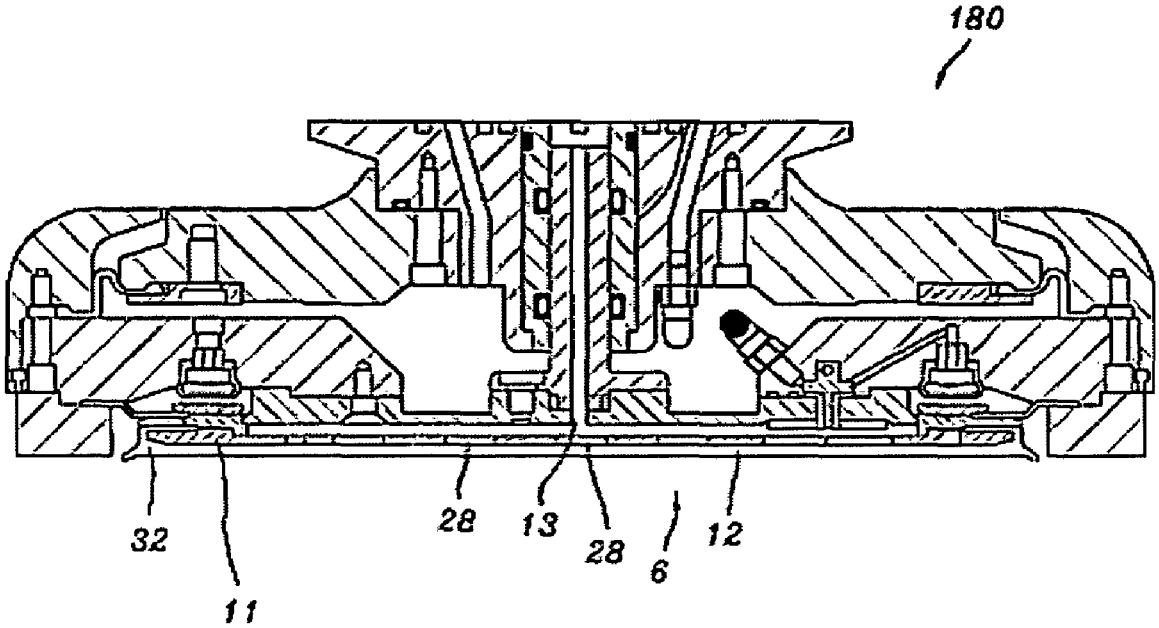
FIG. 1 is a sectional view showing a conventional carrier head.
Figure 2:
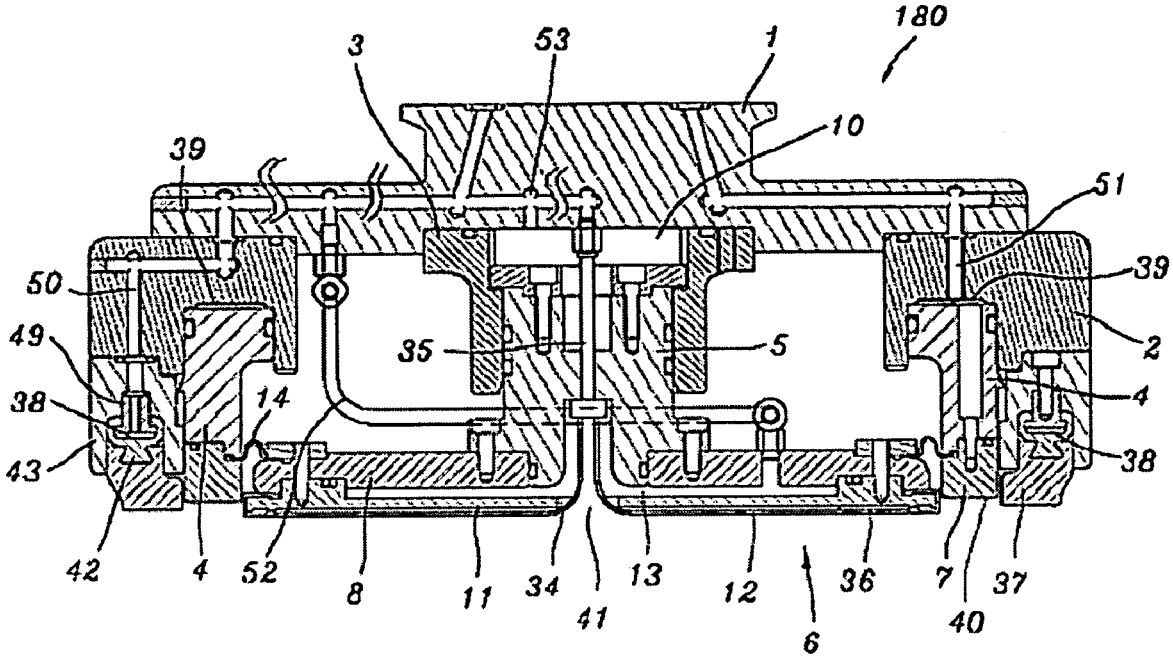
FIG. 2 is a sectional view showing a carrier head according to one embodiment of the present invention.
Figure 3:
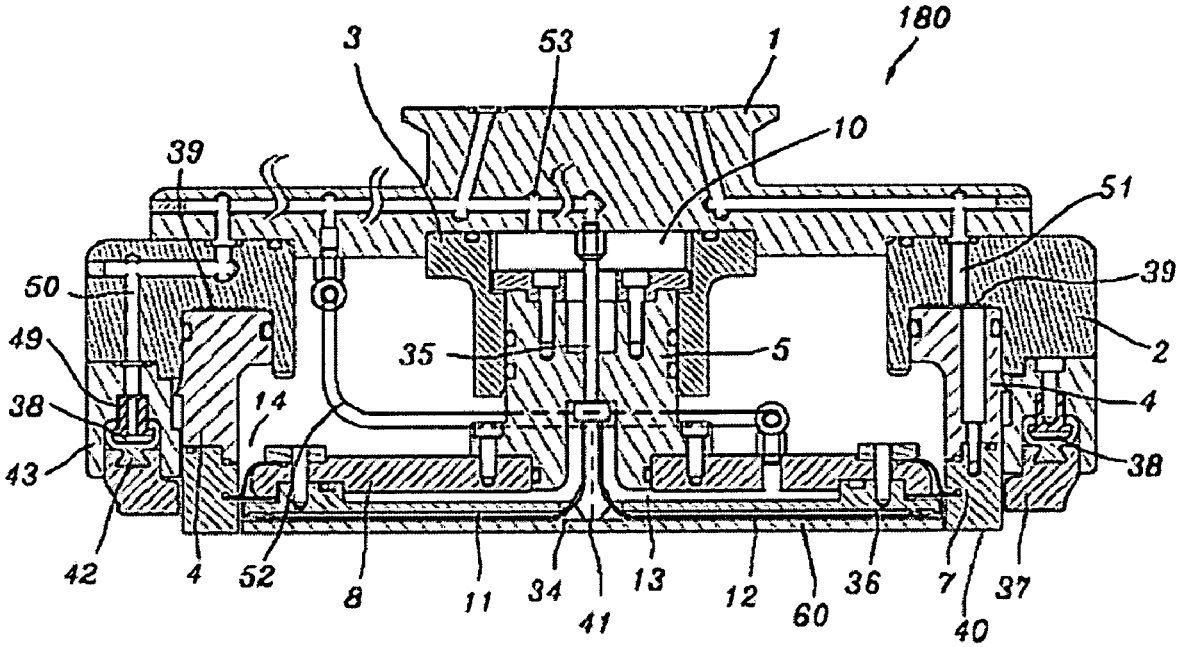
FIG. 3 is a sectional view of a carrier head according to one embodiment of the present invention, in which a wafer is attached to the carrier head by applying vacuum pressure to the wafer.
Figure 4:
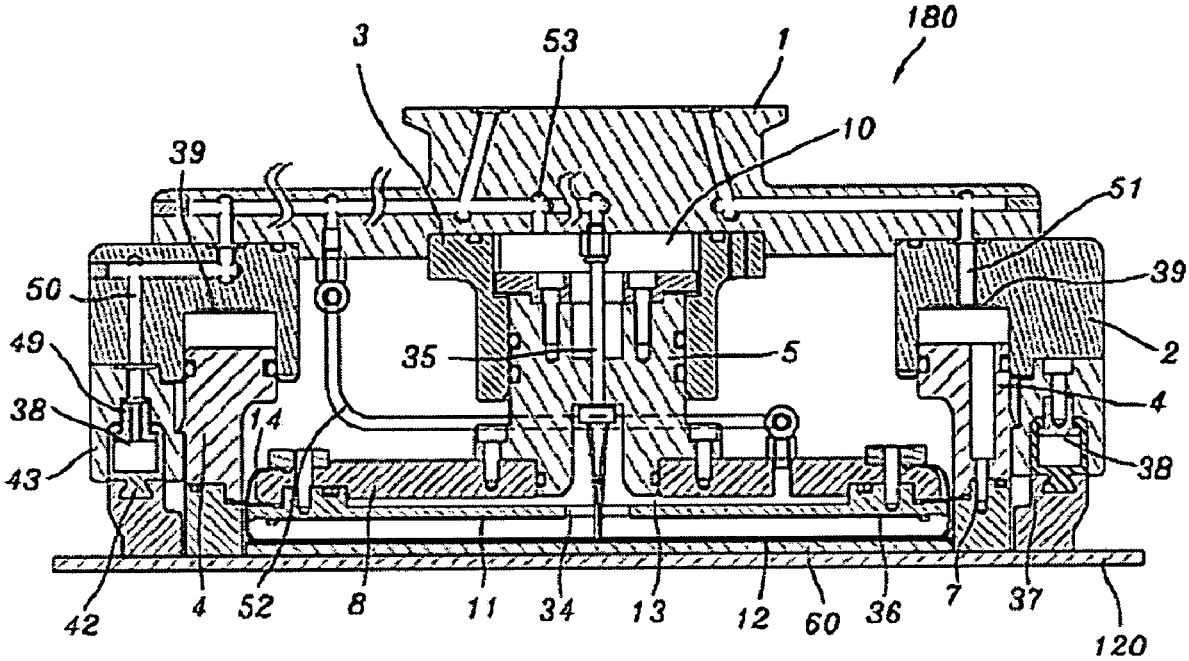
FIG. 4 is a sectional view of a carrier head according to one embodiment of the present invention, in which a wafer is pressed in the carrier head.
Figure 5:
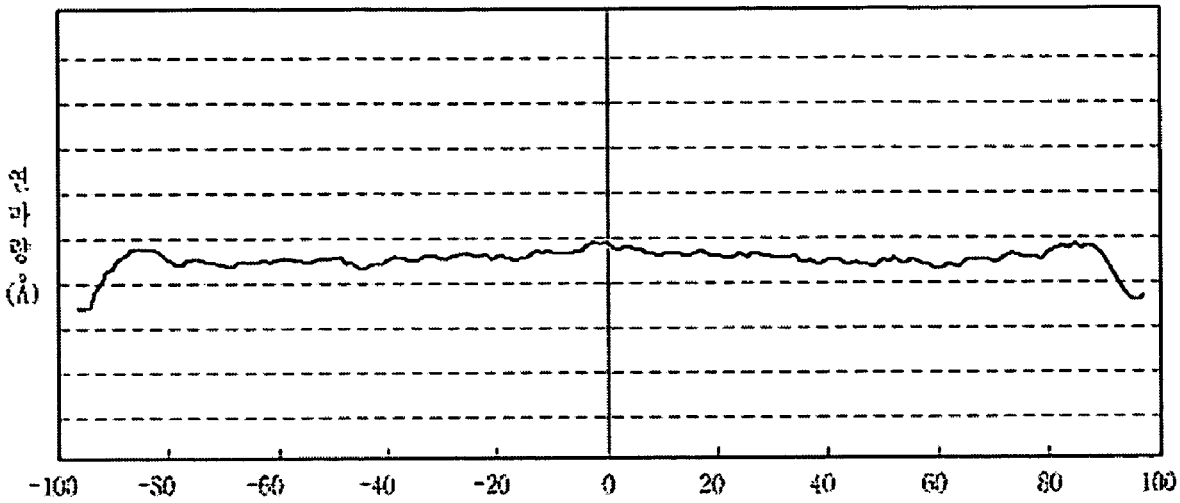
FIG. 5 is a graph showing a status of a wafer polished by a carrier head according to one embodiment of the present invention and FIG. 6 is a cross sectional view of a membrane according to one embodiment of the present invention.

FIG. 2 is a sectional view showing a carrier head according to one embodiment of the present invention, FIG. 3 is a sectional view of the carrier head according to one embodiment of the present invention, in which a wafer is attached to the carrier head by applying vacuum pressure to the wafer, FIG. 4 is a sectional view of the carrier head according to one embodiment of the present invention, in which the wafer is pressed in the carrier head, and FIG. 5 is a graph showing a polishing state of a wafer when the wafer is polished by using the carrier head according to one embodiment of the present invention.

A carrier head 180 according to the present invention is fixed to a carrier driving shaft (not shown) and includes a carrier housing 1, a holder housing 3, a wafer support assembly 6, a retainer ring housing 2, a retainer ring holder 4, a retainer ring 7, a conditioner ring housing 43, and a conditioner 37.

The carrier housing 1 is fixed to the carrier driving shaft (not shown) in such a manner that it can rotate about a rotational axis, which is substantially perpendicular to a surface of a polishing pad.

The holder housing 3 is a ring-shaped body installed coaxially with the carrier housing 1 at a lower portion of the carrier housing 1. The wafer support assembly 6 vertically moves up and down along an inner wall of the holder housing 3 by means of pneumatic pressure. The holder housing 3 is formed at a predetermined inner portion thereof with a stepped section for ensuring a lower limit position of the wafer support assembly 6 when the wafer support assembly 6 is moved down due to tare thereof.

The wafer support assembly 6 is used for easily loading a wafer 60 on the carrier head 180. The wafer support assembly 6 is vertically moved up and down by means of pressure supplied from a mounting chamber 10 communicated with a pressure pipe 53. When the wafer 60 is loaded on the wafer support assembly 6, pneumatic pressure is provided to the wafer support assembly 6 through a passage of the holder housing 3 so that the wafer support assembly 6 is moved down. In addition, when the wafer 60 is unloaded from the wafer support assembly 6 after the polishing process has been finished, the wafer support assembly 6 is moved up.

The wafer support assembly 6 includes a holder shaft 5 inserted into a hold formed at a center of the holder housing 3 in such a manner that the holder shaft 5 can vertically move up and down, a membrane upper holder 8 installed at a lower portion of the holder shaft 5 in order to support both ends of a membrane 12, and a membrane lower holder 11 installed at a lower porton of the membrane upper holder 8. The membrane 12 is fixedly aligned in a manner that the outer peripheral end of the membrane 12 is clamped between and by the outer end of the membrane upper holder 8 and the outer end of the membrane lower holder 11 as to provide a mounting surface for the wafer 60. The membrane 12 also wraps the lower surface of the membrane lower holder 11.

An adjustment chamber 13 is formed between the membrane upper holder 8 and the membrane lower holder 11 in order to adjust internal pressure of a space section formed between the membrane upper holder 8 and the membrane lower holder 11. In addition, the inner peripheral end of the membrane 12 is fixed to the lower end of a vacuum pipe 35 through the holder shaft 5 as a central upper end of the adjustment chamber 13.

The membrane lower holder 11 has a perforated hole 34 at a center thereof. When pressure is applied to the adjustment chamber 13 through the pressure pipe 52 while polishing the wafer 60, such pressure is uniformly applied to a rear surface of the membrane 12 through the perforated hole 34, thereby preventing the wafer 60 from sliding on the membrane 12. In addition, such pressure is evenly applied over the whole surface of the wafer 60, so the surface of the wafer 60 can be evenly polished.

Figure 6:
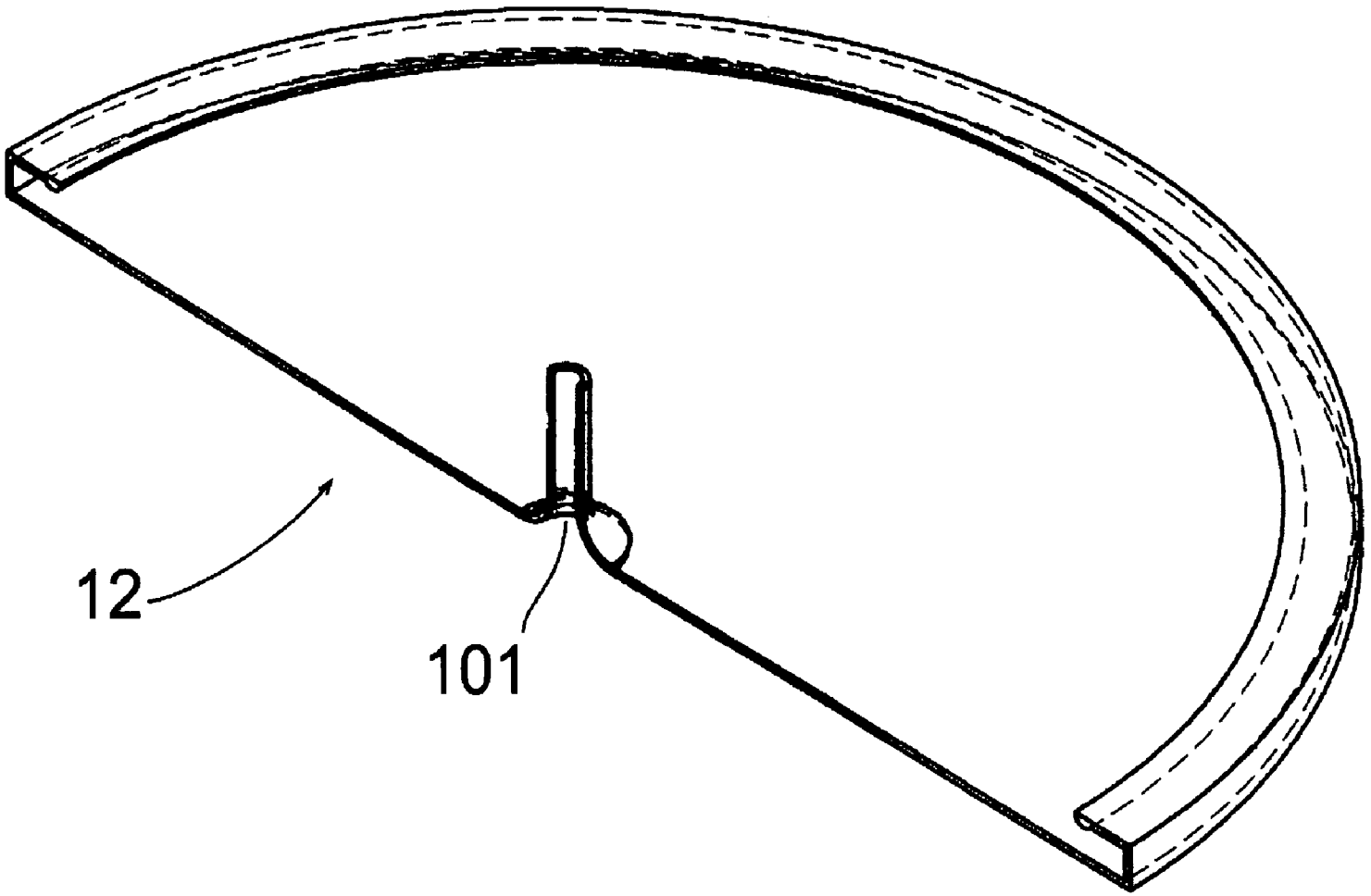

The membrane 12 is made from flexible material and the mounting surface for the wafer 60 is provided at a lower surface of the membrane 12. Preferably, the membrane 12 has a diameter slightly larger than a diameter of the wafer 60. The flexible suction part 41 is formed along a center hole 101 of the membrane 12 as illustrated in FIG. 6. The wafer suction part 41 is connected to a vacuum pipe 35 by passing through the perforated hole 34 formed in the membrane lower holder 11 in order to directly apply vacuum pressure to the wafer 60.

The wafer suction part 41 is communicated with the vacuum pipe 35 connected to the carrier housing 1 so as to adjust pneumatic pressure such that vacuum pressure and atmospheric pressure are properly maintained. Deionized water is easily supplied through the vacuum pipe 35 so that the vacuum pipe 35 and the carrier head 180 can be easily cleaned.

The retainer ring housing 2 is attached to a lower end of the carrier housing 1 and is formed at a lower portion thereof with an annular groove to install the retainer ring holder 4 and the conditioner ring housing 43 in the annular groove.

The retainer ring holder 4 is slidably inserted into the annular groove of the retainer ring housing 2 and a retainer ring chamber 39 communicated with a pressure pipe 51 is formed between the retainer ring holder 4 and the retainer ring housing 2.

The retainer ring 7 is fixed to the retainer ring holder 4 connected to the wafer support assembly 6 by means of a flexer 14, which prevents impurities from penetrating into the carrier head 180. Thus, the retainer ring 7 can be moved up and down regardless of the vertical movement of the wafer support assembly 6 by controlling pressure of the retainer ring chamber 39 connected to the pressure pipe 51. The retainer ring 7 is made from hard plastic or ceramic material and has an annular shape having a flat bottom surface 40.

The retainer ring 7 is moved up and down by means of pneumatic pressure supplied from the retainer ring chamber 39. When polishing the wafer 60, the retainer ring 7 is moved down, and a platen (not shown) of a table is moved up. In this state, the retainer ring 7 makes contact with a polishing pad 120, thereby forming a wafer accommodating space for preventing the wafer 60 from being separated from the mounting surface of the membrane 12.

The conditioner ring housing 43 is fixedly attached to an outer portion of the retainer ring housing 2 and is formed at a lower portion thereof with an annular recess to which a ring tube clamp 49 and a conditioner ring tube 42 are secured. A conditioner ring chamber 38 communicated with a pressure pipe 50 is formed in a space section formed in the conditioner ring housing 43.

The height of the conditioner 37 is adjustable regardless of the vertical movement of the wafer support assembly 6 by means of pneumatic pressure of the conditioner chamber communicated with the pressure pipe 50. The conditioner directly makes contact with a polishing pad 120 (FIG. 4) so as to adjust the roughness of the polishing pad 120.

Conditioning work for the polishing pad 120 is carried out while polishing the wafer 60 by applying proper pressure to the polishing pad 120 based on a sort and a surface roughness of the polishing pad 120. That is, conditioning work for the polishing pad 120 can be carried out by means of the conditioner 37 capable of moving up and down during the polishing process for the wafer 60 and after the polishing process.

Hereinafter, a suction process for the wafer 60 will be described with reference to FIG. 3.

Referring to FIG. 3, the carrier head 180 is pushed up by means of a loading cup (not shown), and vacuum pressure is applied to the carrier head 180 through the vacuum pipe 35 provided at the center of the carrier head 180 when the carrier head 180 is stopped. At this time, vacuum is formed in the wafer suction part 41 due to a sealing action between the wafer 60 and the membrane 12. Then, pressure is applied to the retainer ring chamber 39, so that the retainer ring 7 is downwardly moved in order to start the polishing process for the wafer 60. Accordingly, the retainer ring 7 is positioned in a standby state for the chemical mechanical polishing process.

After polishing the wafer 60, it is required to attract the wafer 60 placed on the polishing pad 120 by means of the carrier head 180 using vacuum force. At this time, since surface tension is created on the surface of the wafer 60 due to residual slurry or deionized water formed between the polishing surface of the wafer 60 and the polishing pad 120, greater suction force is necessary to detach the wafer 60 from the polishing pad 120 as compared with suction force applied the wafer 60 when loading the wafer 60 by using the loading cup (not shown). In order to allow the wafer 60 to make contact with the membrane 12 of the carrier head 180 such that the wafer 60 is subject to vacuum suction, vacuum pressure is applied to the retainer ring chamber 39 so as to move up the retainer ring 7, and at the same time, vacuum pressure is also applied to the vacuum pipe 35, thereby attracting the wafer 60.

FIG. 4 is a sectional view showing a pressurized state of each chamber used for performing the chemical mechanical polishing process for the wafer 60. As shown in FIG. 4, the retainer ring 7 has been moved down and the platen (not shown) having the polishing pad 120 thereon has been moved up. During the polishing process for the wafer 60, fluid pressure supplied into the carrier head 180 is transferred to the adjustment chamber 13 through a pressure pipe 52. In addition, the membrane 12 is expanded while opening the perforated hole 34 due to elastic characteristic of the membrane 12. At this time, pressure is uniformly distributed over the whole area of the wafer 60 based on known physical principles, and a hole section which is a part of the wafer suction part 41 temporarily disappears when attracting the wafer 60. In addition, uniform pressure is applied to a central portion of the wafer 60.

In addition, pressure is applied to the conditioner chamber 38 to perform conditioning work for the polishing pad 120. As such, the conditioner ring tube 42 made from elastic material is expanded at the same time the conditioner 37 is moved down. Accordingly, the conditioning work can be carried out with respect to the polishing pad 120 during the polishing process or after the polishing process.

According to the chemical mechanical polishing apparatus of the present invention, the wafer 60 is attached to the wafer carrier 180 by directly applying vacuum pressure to the wafer 60, so it is possible to check whether or not the wafer 60 is properly accommodated on the carrier head 180 at the proper pressure without requiring an additional device for detecting the wafer 60. If the wafer 60 is dropped from the carrier head 180 or positioned incorrectly along the carrier head 180, the wafer status may be easily recognized by detecting any variations of vacuum pressure in the vacuum pipes installed passing through the carrier head 180 without using an additional device. That is, when the wafer 60 is dropped from the carrier head 180, the pressure variations are transmitted into a pressure adjusting unit (not shown) connected to the vacuum pipe 35 and installed at an exterior of the carrier head 180. Thus, the pressure adjusting unit may measure any pressure variations, thereby stopping the polishing process if it is determined that the wafer 60 is dropped from the carrier head 180.

In addition, in the carrier head of the chemical mechanical polishing apparatus according to the present invention, it is possible to install an additional sensing device in the polishing pad 120 for detecting the wafer 60 when the wafer 60 deviates from its position beyond the retainer ring 7 while the polishing process is being carried out through an interaction between the carrier head 180 and the polishing pad 120.

As noted above, a residual slurry can remain on the polishing pad 120 after the chemical mechanical polishing process has been carried out. Such residual slurry may directly penetrate into a vacuum line when the wafer 60 is lifted up by means of the carrier head 180 or may adhere to the carrier head 180 after the chemical mechanical polishing process has been finished. Any such slurry remaining in the vacuum line for a long period of time can harden in the vacuum line so that fluid cannot smoothly flow through the vacuum line. In addition, any slurry adhering to the carrier head 180 may cause scratching on the surface of the wafer 60 during the chemical mechanical polishing processor increase friction when internal parts of the carrier head 180 are moved, thereby disturbing the movement of the internal parts. In order to solve the above problem, according to the present invention, deionized water is intermittently fed through the vacuum pipe 35 before or after the chemical mechanical process, thereby cleaning the vacuum line.

After constructing the carrier head 180 of the chemical mechanical polishing apparatus according to the present invention, the wafer 60 has been polished by using the carrier head 180. As a result, the whole surface of the wafer 60 is uniformly polished with a uniform thickness as represented by the graph shown in FIG. 5.

As can be seen from the foregoing, the carrier head 180 of the chemical mechanical apparatus according to the present invention attracts the wafer 60 by directly applying vacuum pressure to the wafer 60, so a suction error or suction fault is reduced in relation to the wafer 60. In addition, the present invention can easily check whether or not the wafer 60 is properly accommodated on the mounting surface of the flexible membrane 12 at proper vacuum pressure, thereby improving reliability of the chemical mechanical polishing process while achieving superior polishing quality for the wafer 60.

In addition, according to the present invention, slurry remaining in the vacuum line or adhering to a gap of the carrier head 180 can be washed by feeding deionized water into the vacuum line, so that the carrier head 180 of the chemical mechanical polishing apparatus can be prevented from being contaminated. That is, the chemical mechanical polishing apparatus of the present invention can reduce the suction error or suction fault in relation to the wafer 60, so the chemical mechanical polishing apparatus can be operated without being disturbed by a misalignment of the wafer 60. In addition, since the chemical mechanical polishing apparatus of the present invention can completely wash impurities remaining in the carrier head 180 or the vacuum line, reliability of the chemical mechanical polishing apparatus and productivity of semiconductor devices may be improved.

While this invention has been described in connection with what is presently considered to be the most practical and preferred embodiment, it is to be understood that the invention is not limited to the disclosed embodiment and the drawings, but, on the contrary, it is intended to cover various modifications and variations within the spirit and scope of the appended claims.

The invention claimed is:

1. A carrier head of a chemical mechanical polishing apparatus, the carrier head comprising:

a carrier housing driven by a carrier driving shaft;

a holder housing installed coaxially with the carrier housing at a lower portion of the carrier housing and having a ring shape;

a wafer support assembly vertically moving up and down along an inner wall of the holder housing; and a mounting chamber for allowing the wafer support assembly to slidably move up and down along the inner wall of the holder housing formed at a center of the holder housing, wherein the wafer support assembly includes an adjustment chamber, to which pressure is applied, and a membrane having a second hole at a center thereof, pressurized fluid is introduced into the adjustment chamber through the pressure pipe while a polishing process is being carried out so that the membrane is outwardly expanded, thereby applies pressure substantially evenly to a rear surface of a wafer, a suction part being formed at a center of the membrane such that the suction part is connected to a vacuum pipe by passing through the adjustment chamber, and a retainer ring being installed at an outer portion of the wafer support assembly in such a manner that the retainer ring vertically moves, wherein the wafer support assembly includes a holder shaft inserted into a first hole formed at a center of the holder housing and vertically movable in the first hole, a membrane upper holder mounted at a lower portion of the holder shaft, and a membrane lower holder positioned at a lower portion of the membrane upper holder, wherein the membrane wraps a lower surface of the membrane lower holder;

wherein an outer peripheral end of the membrane is clamped between and by an outer end of the membrane upper holder and an outer end of the membrane lower holder so as to provide a mounting surface for the wafer; and wherein an inner peripheral end of the membrane is fixed to a lower end of a vacuum pipe through the holder shaft at a center upper end of the adjustment chamber.

2. The carrier head as claimed in claim 1, further comprising a conditioner installed at an outer portion of the retainer ring in such a manner that the conditioner vertically moves.

3. The carrier head as claimed in claim 1, further comprising a cleaning apparatus for supplying cleaning solution into the vacuum pipe.

4. The carrier head as claimed in claim 1, further comprising a vacuum pressure measuring unit connected to the vacuum pipe in order to measure vacuum pressure in the vacuum pipe.

* * * * *